US008522739B2

(12) United States Patent
Pflügl et al.

(10) Patent No.: US 8,522,739 B2
(45) Date of Patent: Sep. 3, 2013

(54) ROLLER SEATING DEVICE

(75) Inventors: Mathias Pflügl, Vienna (AT); Karsten Staab, Vienna (AT)

(73) Assignee: Continental Automotive GmbH, Hannover (DE)

( * ) Notice: Subject to any disclaimer, the term of this patent is extended or adjusted under 35 U.S.C. 154(b) by 395 days.

(21) Appl. No.: 12/304,884

(22) PCT Filed: Mar. 16, 2007

(86) PCT No.: PCT/EP2007/052512
§ 371 (c)(1),
(2), (4) Date: Jun. 1, 2009

(87) PCT Pub. No.: WO2007/147654
PCT Pub. Date: Dec. 27, 2007

(65) Prior Publication Data

US 2010/0064844 A1 Mar. 18, 2010

(30) Foreign Application Priority Data

Jun. 20, 2006 (DE) ..... 10 2006 028 348

(51) Int. Cl.
*F01L 1/14* (2006.01)

(52) U.S. Cl.
USPC ..... 123/90.48; 74/569

(58) Field of Classification Search
USPC ..... 123/90.48, 90.35, 90.5, 90.52, 90.53, 123/90.54, 90.55, 90.56, 90.57, 90.58, 90.59, 123/90.15, 90.16; 74/569
See application file for complete search history.

(56) References Cited

U.S. PATENT DOCUMENTS

| | | | | | |
|---|---|---|---|---|---|
| 3,382,854 | A | * | 5/1968 | Steiner | 123/90.16 |
| 3,822,683 | A | * | 7/1974 | Clouse | 123/90.5 |
| 4,361,120 | A | * | 11/1982 | Kueny | 123/90.55 |
| 4,449,609 | A | | 5/1984 | Stoll | 181/230 |
| 5,239,951 | A | * | 8/1993 | Rao et al. | 123/90.5 |
| 5,566,652 | A | * | 10/1996 | Deppe | 123/90.35 |
| 5,606,939 | A | * | 3/1997 | Spath | 123/90.5 |
| 5,673,657 | A | * | 10/1997 | Cecur | 123/90.5 |

(Continued)

FOREIGN PATENT DOCUMENTS

| | | |
|---|---|---|
| DE | 2340074 A1 | 2/1975 |
| DE | 32 47 026 A1 | 6/1984 |

(Continued)

OTHER PUBLICATIONS

Written Opinion of International Searching Authority for PCT/EP2007/052512, 2 pages, Dec. 18, 2008.

(Continued)

*Primary Examiner* — Thomas Denion
*Assistant Examiner* — Daniel Bernstein
(74) *Attorney, Agent, or Firm* — King & Spalding L.L.P.

(57) ABSTRACT

A roller seating device has a hollow-cylindrical element (1) in which a roller (4) is received in seats (8, 10) perpendicular to a center axis (6) of the hollow-cylindrical element (1). A securing element (12) is configured and arranged to couple in a form-fit to the hollow-cylindrical element (1) in the interior (14) of the hollow-cylindrical element (1) in a direction that is axial and rotatory with respect to the center axis (6) of the hollow-cylindrical element (1) and in such a manner as to fix the roller (4) on its faces (16, 18) axially to the center axis (6) of the roller (4).

15 Claims, 3 Drawing Sheets

(56) References Cited

U.S. PATENT DOCUMENTS

| | | | | |
|---|---|---|---|---|
| 5,676,098 | A * | 10/1997 | Cecur | 123/90.5 |
| 6,216,583 | B1 | 4/2001 | Klinger et al. | 92/129 |
| 6,688,269 | B1 | 2/2004 | Steinmetz | 123/90.48 |
| 7,497,157 | B2 * | 3/2009 | Aoki et al. | 92/129 |

FOREIGN PATENT DOCUMENTS

| | | | |
|---|---|---|---|
| DE | 3247026 | A1 | 6/1984 |
| DE | 44 21 535 | A1 | 12/1995 |
| DE | 4421535 | A1 * | 12/1995 |
| DE | 197 29 793 | A | 1/1999 |
| DE | 19729793 | | 1/1999 |
| DE | 199 09 418 | A1 | 9/2000 |
| DE | 19909418 | A1 | 9/2000 |
| DE | 101 57 076 | A1 | 5/2003 |
| DE | 10157076 | A1 | 5/2003 |
| EP | 0 074 458 | A | 2/1982 |
| EP | 0074458 | | 2/1982 |
| EP | 0 770 762 | A | 5/1997 |
| EP | 0 770 763 | A | 5/1997 |
| EP | 0770762 | A1 | 5/1997 |
| EP | 0770763 | A1 | 5/1997 |
| GB | 1429146 | A | 3/1976 |
| JP | 49095062 | A | 9/1974 |
| JP | 58107808 | A | 6/1983 |
| JP | 6203274 | A | 7/1994 |
| JP | 9125915 | A | 5/1997 |
| JP | 2003515693 | A | 5/2003 |
| JP | 2003522903 | A | 7/2003 |
| JP | 2004204761 | A | 7/2004 |
| WO | WO 01/40632 | A | 6/2001 |
| WO | WO 0140632 | A1 | 6/2001 |

OTHER PUBLICATIONS

Japanese Office Action, Japanese Patent Application No. 2009-515789, 12 pages, Mar. 7, 2012.

* cited by examiner

ROLLER SEATING DEVICE

CROSS-REFERENCE TO RELATED APPLICATIONS

This application is a U.S. National Stage Application of International Application No. PCT/EP2007/052512 filed Mar. 16, 2007, which designates the United States of America, and claims priority to German Application No. 10 2006 028 348.1 filed Jun. 20, 2006, the contents of which are hereby incorporated by reference in their entirety.

TECHNICAL FIELD

The invention relates to a roller mounting device, which may be used, for example, as a roller tappet in a roller tappet pump.

BACKGROUND

Roller tappet pumps of this type are used, for example, in internal combustion engines, in particular in diesel internal combustion engines, for generating high pressure in the fuel supply. High-pressure pumps in internal combustion engines may be driven, for example, by a camshaft to impose a predefined stroke movement on high-pressure cylinders of the high-pressure pump. The raising of the particular cams of the camshaft is transmitted in these cases via the roller tappets to the high-pressure pistons of the high-pressure pump.

A roller tappet is known from EP 0 074 458, having a cylindrical guide body, which has two bearing parts for retaining an axle, on which a roller is mounted so it is rotatable. The bearing parts have two bearing cavities open on top, in which the axle ends of an axle are laid, on which the roller is mounted so it is rotatable. A recess in the roller tappet is implemented in such a way that the roller is axially fixed.

A roller tappet having a tappet, which carries an axially and radially guided roller, is known from DE 101 57 076 A1. The tappet has a roller shoe, into which the roller is introduced so it is rotatable with axial play. A roller shoe of the tappet accommodates the roller in a recess. The recess of the roller shoe tapers toward a lower edge of the roller shoe in such a way that the roller is prevented from falling out of the roller shoe.

A roller tappet is known from DE 199 09 418 A1, having a main body, a roller, and a roller axle for the roller mounted in the main body. The angular range in which the roller axle is mounted in the main body is at most 180°. Furthermore, means are provided which fix the roller axle in relation to the main body in the axial direction of the main body and which comprise a sheet metal cage, which is clamped on the main body and has tabs which wrap around partial areas of the axle.

A piston pump for high-pressure fuel supply is known from DE 197 29 793, having a tappet which has a reversible roller on its radial internal area, which is supported so it may roll against a driveshaft of the piston pump in the area of its protrusions around the circumference.

A roller tappet having a cage retainer is known from DE 44 21 535 A1, the roller tappet comprising a roller shoe in which a roller is guided in a formfitting way, via which the roller tappet presses against a cam ring. The roller shoe has a retention element for fixing the position of the roller.

An elastic roller tappet is known from DE 32 47 026 A1, having a roller on whose front faces a coaxially situated depression is implemented, to thus generate the elasticity of the roller boundary area.

SUMMARY

According to various embodiments, a roller mounting device can be provided which is simple and reliable.

According to an embodiment, a roller mounting device may comprise a hollow-cylindrical element, in which a roller is mounted transversely to a central axis of the hollow-cylindrical element in bearings, and a securing element coupled in a formfitting way to the hollow-cylindrical element in an inner chamber of the hollow-cylindrical element in relation to axial and rotational directions on the central axis of the hollow-cylindrical element, wherein the securing element fixes the roller on its front faces axially to the central axis of the roller.

According to a further embodiment, the securing element can be implemented and situated in such a way that it is coupled to the roller in the area of the centers of the front faces. According to a further embodiment, the securing element can be implemented and situated in such a way that it secures the roller from leaving the bearings in the direction of the central axis of the hollow-cylindrical element. According to a further embodiment, the securing element can be implemented as wire-shaped at least in the area in which it overlaps the front faces of the roller. According to a further embodiment, the securing element can be implemented as springy in such a way that it automatically braces itself in the inner chamber of the hollow-cylindrical element. According to a further embodiment, a groove, in which the securing element engages, can be implemented in the inner chamber of the hollow-cylindrical element. According to a further embodiment, the securing element can be coupled in a formfitting way to the hollow-cylindrical element in an area of a feedthrough through a wall of the hollow-cylindrical element in relation to the rotational direction on the central axis of the hollow-cylindrical element. According to a further embodiment, the securing element can be provided with tabs, which are situated in the inner chamber of the hollow-cylindrical element and via which a force for the elastic deformation of the securing element for installation in the hollow-cylindrical element may be introduced. According to a further embodiment, the tabs can be implemented in such a way that they secure the roller from leaving the bearings in the direction of the central axis of the hollow-cylindrical element.

BRIEF DESCRIPTION OF THE DRAWINGS

Exemplary embodiments are explained in greater detail hereafter on the basis of the schematic drawings. In the figures.

DETAILED DESCRIPTION

Figure 1:
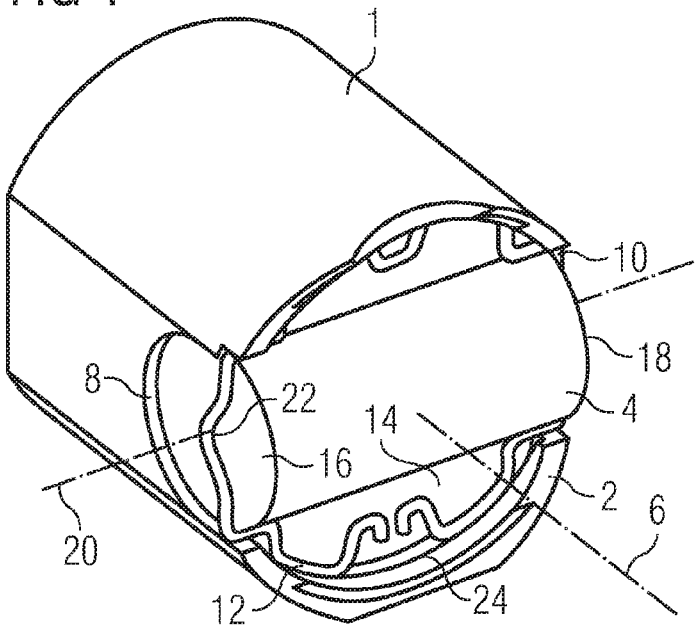
FIG. 1 shows a first view of a first exemplary embodiment.

The various embodiments are distinguished by a roller mounting device having a hollow-cylindrical element, in which a roller is mounted transversely to a central axis of the hollow-cylindrical element in bearings. A securing element is provided, which is implemented and situated in such a way that it is coupled in a formfitting way to the hollow-cylindrical element in an inner chamber of the hollow-cylindrical element in relation to axial and rotational directions on the central axis of the hollow-cylindrical element, and it fixes the roller on its front faces axially to the central axis of the roller.

In this way, the roller may easily be prevented from traveling away from its predefined axial position in relation to its central axis during operation of the roller mounting device. In addition, because the securing element is implemented and situated in such a way that it is coupled to the hollow-cylindrical element in a formfitting way in an inner chamber of the hollow-cylindrical element in relation to axial and rotational directions on the central axis of the hollow-cylindrical element, an external area of the hollow-cylindrical element may be kept essentially free of the securing element and thus be used as a runway, for example, and may advantageously be used for supporting lateral forces in this context. In this way, a lower surface pressure may be ensured in the area of the runway, which is advantageous in regard to the running properties.

According to an embodiment of the roller mounting device, the securing element is implemented and situated in such a way that it is coupled to the roller in the area of the centers of the front faces. In this way, a sliding friction between the securing element and the roller may be kept very low.

According to a further embodiment, the securing element is implemented and situated in such a way that it secures the roller from leaving the bearing in the direction of the central axis of the hollow-cylindrical element. In this way, in particular in connection with an open mounting, a loss of the roller may be prevented. This may otherwise occur because of negative resulting contact forces, caused by corresponding mass inertial forces, during operation of the roller mounting device, in particular in connection with a driveshaft implemented as a camshaft.

According to a further embodiment, the securing element is implemented as wire-shaped at least in the area in which it overlaps the front faces of the roller. This allows an especially simple production of the securing element and an especially simple implementation of the desired geometry, at least in the area in which it covers the front face of the roller.

In particular even if the securing element is also implemented as wire-shaped outside the area of the front faces of the roller, it may thus have suitable springy properties especially simply.

According to a further embodiment, the securing element is implemented as springy in such a way that it automatically braces itself in the inner chamber of the hollow-cylindrical element. In this way, especially simple fixing of the securing element in the inner chamber of the hollow-cylindrical element is made possible.

According to a further embodiment, a groove is implemented in the inner chamber of the hollow-cylindrical element, in which the securing element engages. In this way, the securing element may be especially simply coupled in a formfitting way to the hollow-cylindrical element in relation to the axial direction the central axis of the hollow-cylindrical element.

According to a further embodiment, the securing element is coupled in a formfitting way to the hollow-cylindrical element in an area of a feed-through through a wall of the hollow-cylindrical element in relation to the rotational direction on the central axis of the hollow-cylindrical element. In this way, an especially reliable rotational lock may be ensured and, in addition, the feed-through to the front faces of the roller may be achieved.

According to a further embodiment, the securing element is provided with tabs which are situated in the inner chamber of the hollow-cylindrical element and via which a force may be introduced for the elastic deformation of the securing element for the installation in the hollow-cylindrical element. In this way, especially simple installation of the securing element in the hollow-cylindrical element is made possible.

In this context, it may be especially advantageous if the tabs are implemented in such a way that they secure the roller from leaving the bearing in the direction of the central axis of the hollow-cylindrical element. In this way, the tabs may both advantageously be used in regard to the installation and also additionally secure the roller from leaving the bearing.

Elements of identical design or function are identified by identical reference numerals in all of the figures.

A roller mounting device (see FIG. 1) has a hollow-cylindrical element 1. The hollow-cylindrical element is preferably coupled to a piston, such as a high-pressure pump, as is used in internal combustion engines.

The hollow-cylindrical element 1 has a wall 2.

Figure 3:
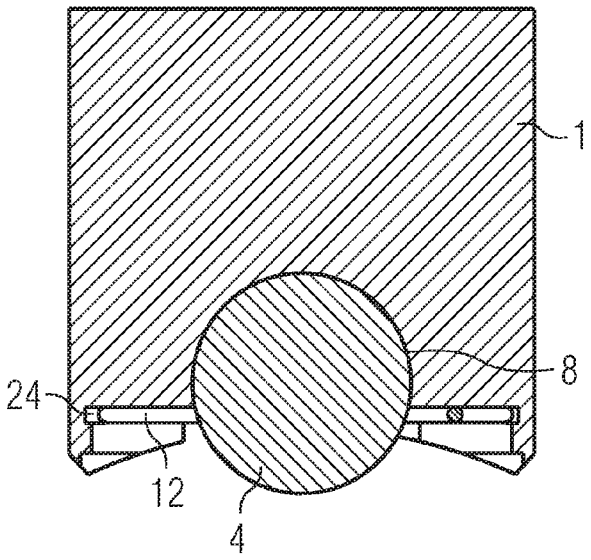
FIG. 3 shows a third view of the exemplary embodiment from FIG. 1.
Figure 4:
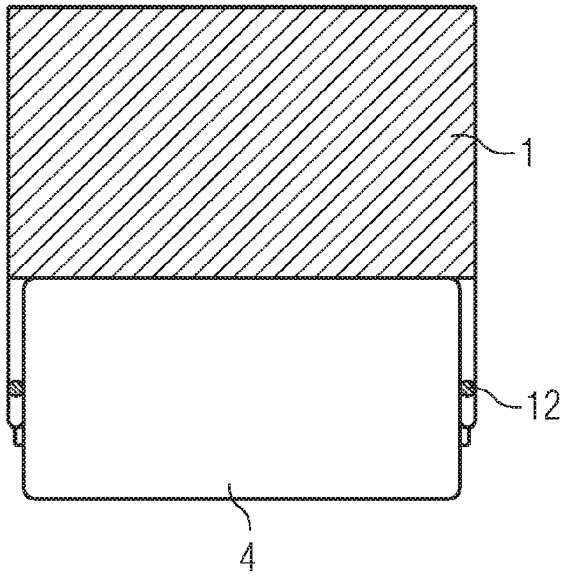
FIG. 4 shows a fourth view of the exemplary embodiment from FIG. 1.

A roller 4 is provided, which is implemented in the form of a roll. The roller 4 is mounted transversely to a central axis 6 of the hollow-cylindrical element 1 in bearings 8, 10, which are implemented in the wall 2 of the hollow-cylindrical element 1. The section of FIG. 3 shows that the bearing 8 wraps around the roller by more than 180°, for example, 200°. In this case, the roller 4 is secured against leaving the bearings 8, 10. The bearings 8, 10 may also be implemented, however, so that they enclose the roller by less than or equal to 180°.

Upon proper operation of the roller mounting device, the roller 4 is preferably in contact with a camshaft and rolls thereon or on cams situated thereon. The lift of the particular cam of the camshaft may thus be transmitted via the roller mounting device, preferably to a piston of the high-pressure pump.

A securing element 12 is provided, which is implemented and situated in such a way that it is coupled in a formfitting way to the hollow-cylindrical element 6 in the inner chamber 14 of the hollow-cylindrical element 1 in relation to axial and rotational directions on the central axis 6 of the hollow-cylindrical element 1, and it fixes the roller 4 on its front faces 16, 18 axially to a central axis 20 of the roller 4. The securing element 12 is preferably implemented as wire shaped for this purpose, at least in the area in which it overlaps the front faces 16, 18 of the roller 4.

This securing element 12 is preferably implemented in such a way that it is coupled to the roller in the area of the center of the front faces 16, 18 of the roller 4. For this purpose, it has a suitable geometry, which is shown in FIG. 1, for example. A springy wire is especially well suitable for implementing a geometry of this type, because a geometry of this type is producible especially simply in manufacturing technology using this wire.

The closer the contact between the securing element 12 and the roller 4 occurs to the center 22, the lower the losses by sliding friction caused thereby. In the area of the center 22 of the front faces 16, 18 of the roller 4, the smallest relative velocities exist between the roller 4 and the securing element 12 upon a rotation of the roller 4 and thus possible wear is minimized by a contact which occurs very close to the area of the center 22.

Figure 2:
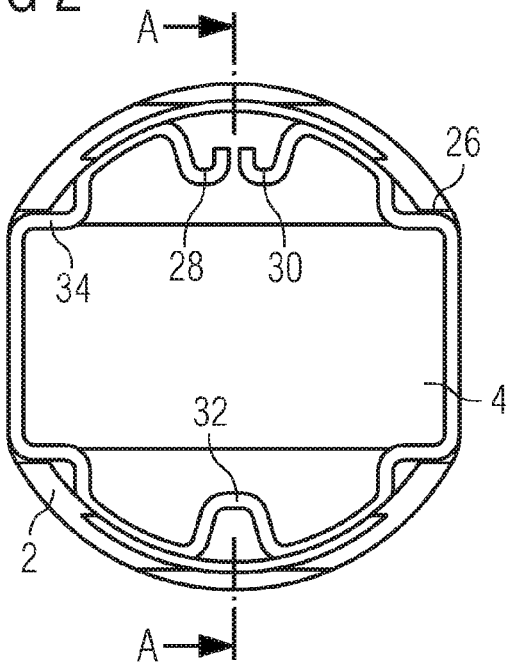
FIG. 2 shows a second view of the exemplary embodiment from FIG. 1.

This securing element 12 is guided from the inner chamber 14 through the wall 2 in the area of a feed-through 26 through the wall 2 of the hollow-cylindrical element 1. The feedthrough is preferably implemented in such a way that, working together with an appropriate shaping of the securing element 12 corresponding to the feed-through, as is obvious from FIG. 2, for example, it allows a formfitting coupling between the securing element 12 and the hollow-cylindrical element 1 in relation to the rotational direction on the central axis 6 of the hollow-cylindrical element 1. In this context, a certain play between the roller and the securing element 12 is preferably provided in the area of the feed-through 26. In this way, undesired friction in this area between the securing element 12 and the roller 4 may be avoided in particular and, additionally, a simple installation of the securing element 12 may be facilitated.

A groove 24, in which the securing element 12 engages, is implemented in the inner chamber 14 of the hollow-cylindrical element 1 in the wall 2. A form fit between the securing element 12 and the hollow-cylindrical element 1 in the axial direction in relation to the central axis 6 of the hollow-cylindrical element 1 may be easily ensured in this way. This securing element 12 is implemented in such a way that it automatically pre-tensions itself when it is situated in the inner chamber 14 of the hollow-cylindrical element 1. For this purpose, it is preferably provided with suitable elastic properties by its geometry in this context. This may be supported, for example, by suitably implemented tabs 28, 30, 32. In this way, when the securing element 12 is situated properly, it automatically braces itself in the inner chamber 14 of the hollow-cylindrical element 1.

Figure 5:
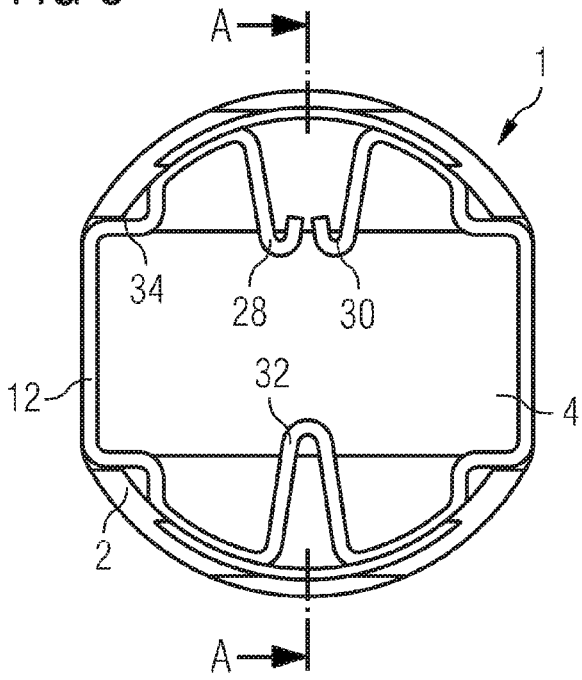
FIG. 5 shows a view of a second exemplary embodiment.
Figure 6:
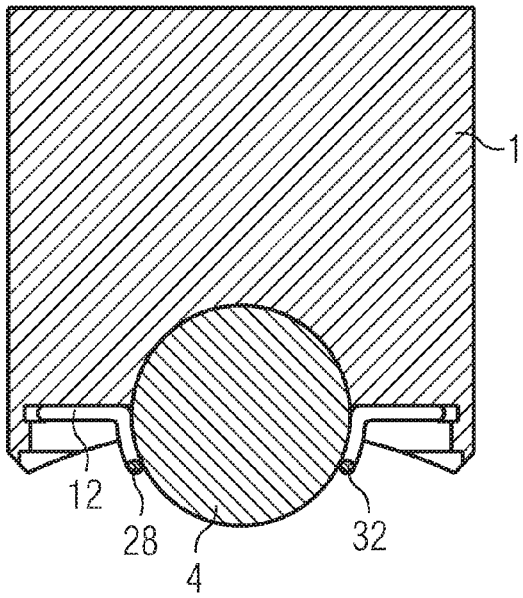
FIG. 6 shows a second view of the exemplary embodiment from FIG. 5.

The tabs 28, 30, 32 are additionally preferably implemented in such a way that a force for appropriate deformation of the securing element 12 may be introduced via them during installation in such a way that the securing element 12 is insertable into the hollow-cylindrical element 1 in the axial direction in relation to the central axis 6 until it engages in the groove 24. In particular in connection with the second exemplary embodiment shown in FIGS. 5 and 6, in which the angle by which the bearings 8, 10 enclose the roller 4 does not exceed 180°, by appropriate implementation of the tabs 28, 30, 32, as shown in FIG. 5, the roller 4 may be secured against leaving the bearings 8, 10 in the direction of the central axis 6 of the hollow-cylindrical element 1. For this purpose, the tabs 28, 30, 32 are preferably implemented correspondingly longer and in such a way that they suitably overlap the roller 4.

The securing element 12 is preferably implemented completely from a wire. However, it may also be at least partially implemented using suitable other elements, so that it may be implemented in the inner chamber 14 by corresponding sheet-metal elements, for example. However, arbitrary further embodiments of the securing element 12 are also conceivable.

The use of a spring wire for the securing element 12 allows an adaptation of the axial roller play especially well. Through suitable shaping of the spring wire, bracing of the roller 4 is thus fundamentally possible. In particular in connection with a contact between the roller 4 and the securing element 12 very close to the center, undesired friction forces are solely of subordinate significance in this context. The spring action, which is advantageous for pressing into the groove 24, may be supported especially simply by the contour 34 of the securing element 12.

The pre-tension of the securing element 12 is preferably to be designed in such a way, in particular if it is to implement securing of the roller from leaving the bearing in the direction of the central axis 6 of the hollow-cylindrical element 1, that the mass inertial forces of the roller 4 occurring during operation cannot press the securing element 12 out of its guide.

What is claimed is:

1. A roller mounting device comprising:

a hollow-cylindrical element, in which a cylindrical roller is mounted transversely to a central axis of the hollow-cylindrical element, the cylindrical roller including a pair of front faces on opposite ends of the roller, a rounded cylindrically-shaped rolling surface between the pair of front faces, and a rotational axis extending through each of the front faces at a geometric center of that front face, and a single-member, wire-shaped securing element coupled in a formfitting way to the hollow-cylindrical element, disposed at least partially within an inner chamber of the hollow-cylindrical element in relation to axial and rotational directions on the central axis of the hollow-cylindrical element, wherein the single-member, wire-shaped securing element includes:

(a) a pair of front face contacting portions configured to physically contact each front face of the cylindrical roller at the geometric center through which the rotational axis extends to fix the roller along the rotational axis of the roller; and (b) rolling surface contacting portions configured to contact the cylindrically-shaped rounded rolling surface of the cylindrical roller at one or more locations forward of the rotational axis of the roller in a direction along the central axis of the hollow-cylindrical element to restrain the roller along the central axis of the hollow-cylindrical element, which is perpendicular to the rotational axis of the roller.

2. The roller mounting device according to claim 1, wherein the rolling surface contacting portions of the roller secure the roller from leaving the hollow-cylindrical element in the direction of the central axis of the hollow-cylindrical element.

3. The roller mounting device according to claim 1, wherein the securing element is implemented as springy in such a way that it automatically braces itself in the inner chamber of the hollow-cylindrical element.

4. The roller mounting device according to claim 1, wherein a groove, in which the securing element engages, is implemented in the inner chamber of the hollow-cylindrical element.

5. The roller mounting device according to claim 1, wherein the securing element is coupled in a formfitting way to the hollow-cylindrical element in an area of a feed-through through a wall of the hollow-cylindrical element in relation to the rotational direction on the central axis of the hollow-cylindrical element.

6. The roller mounting device according to claim 1, wherein the securing element is provided with tabs, which are situated in the inner chamber of the hollow-cylindrical element and via which a force for the elastic deformation of the securing element for installation in the hollow-cylindrical element may be introduced.

7. The roller mounting device according to claim 6, wherein the tabs are implemented in such a way that they secure the roller from leaving the hollow-cylindrical element in the direction of the central axis of the hollow-cylindrical element.

8. A method for providing a roller mounting device having a hollow-cylindrical element, the method comprising the steps of:

mounting a cylindrical roller transversely to a central axis of the hollow-cylindrical element, the cylindrical roller including a pair of front faces on opposite ends of the roller, a cylindrically-shaped rounded rolling surface between the pair of front faces, and a rotational axis extending through each of the front faces at a geometric center of that front face, and providing a single-member, wire-shaped securing element, which is implemented and situated in such a way that it is coupled in a formfitting way to the hollow-cylindrical element and disposed at least partially within an inner chamber of the hollow-cylindrical element in relation to axial and rotational directions on the central axis of the hollow-cylindrical element, the single-member, wire-shaped securing element including (a) a pair of front face contacting portions configured to physically contact each front face of the cylindrical roller at the geometric center through which the rotational axis extends to fix the roller along the rotational axial of the roller, and (b) rolling surface contacting portions configured to contact the cylindrically-shaped rounded rolling surface of the cylindrical roller at one or more locations forward of the rotational axis of the roller in a direction along the central axis of the hollow-cylindrical element to restrain the roller along the central axis of the hollow-cylindrical element.

9. The method according to claim 8, further comprising the step of implementing and situating the securing element in such a way that the rolling surface contacting portions of the roller secure the roller from leaving the hollow-cylindrical element in the direction of the central axis of the hollow-cylindrical element.

10. The method according to claim 8, further comprising the step of implementing the securing element as springy in such a way that it automatically braces itself in the inner chamber of the hollow-cylindrical element.

11. The method according to claim 8, further comprising the step of implementing a groove, in which the securing element engages, in the inner chamber of the hollow-cylindrical element.

12. The method according to claim 8, further comprising the step of coupling the securing element in a formfitting way to the hollow-cylindrical element in an area of a feed-through through a wall of the hollow-cylindrical element in relation to the rotational direction on the central axis of the hollow-cylindrical element.

13. The method according to claim 8, further comprising the step of providing the securing element with tabs, which are situated in the inner chamber of the hollow-cylindrical element and via which a force for the elastic deformation of the securing element for installation in the hollow-cylindrical element may be introduced.

14. The method according to claim 13, further comprising the step of implementing the tabs in such a way that they secure the roller from leaving the hollow-cylindrical element in the direction of the central axis of the hollow-cylindrical element.

15. A roller mounting device comprising:

a hollow-cylindrical element, in which a roller is mounted transversely to a central axis of the hollow-cylindrical element, the roller including a pair of front faces on opposite ends of the roller, a cylindrically-shaped rounded rolling surface between the pair of front faces, and a rotational axis extending through each of the front faces at a geometric center of that front face, and a single-member, wire-shaped securing element physically coupled to each front face of the cylindrical roller at the geometric center through which the rotational axis extends, and coupled in a formfitting way to the hollow-cylindrical element and disposed at least partially within an inner chamber of the hollow-cylindrical element in relation to axial and rotational directions on the central axis of the hollow-cylindrical element such that the single-member, wire-shaped securing element fixes the cylindrical roller on its front faces axially along the rotational axis of the roller, and wherein the single-member, wire-shaped securing element contacts the cylindrically-shaped rounded rolling surface of the cylindrical roller at one or more locations forward of the rotational axis of the roller in a direction along the central axis of the hollow-cylindrical element to secure the cylindrical roller from leaving the hollow-cylindrical element in the direction of the central axis of the hollow-cylindrical element.

* * * * *